US008035586B2

(12) United States Patent
Hayafuji

(10) Patent No.: US 8,035,586 B2
(45) Date of Patent: Oct. 11, 2011

(54) DEVICE FOR DRIVING ACTIVE MATRIX LIGHT-EMITTING DISPLAY PANEL BY CONTROLLING DRIVE VOLTAGE

(75) Inventor: Akinori Hayafuji, Yonezawa (JP)

(73) Assignee: Tohoku Pioneer Corporation, Tendo-shi, Yamagata (JP)

( * ) Notice: Subject to any disclaimer, the term of this patent is extended or adjusted under 35 U.S.C. 154(b) by 1072 days.

(21) Appl. No.: 11/367,279

(22) Filed: Mar. 6, 2006

(65) Prior Publication Data

US 2006/0202913 A1 Sep. 14, 2006

(30) Foreign Application Priority Data

Mar. 8, 2005 (JP) ..... 2005-063754

(51) Int. Cl.
*G09G 3/32* (2006.01)

(52) U.S. Cl. ..... 345/82

(58) Field of Classification Search ..... 345/36, 345/44, 45, 76, 81–83; 315/169.1; 323/312; 348/800; 349/69
See application file for complete search history.

(56) References Cited

U.S. PATENT DOCUMENTS

2002/0175662 A1* 11/2002 Sakurai et al. ..... 323/312
2005/0030268 A1* 2/2005 Zhang et al. ..... 345/83
2005/0225515 A1* 10/2005 Tsuchida et al. ..... 345/76
2005/0258772 A1* 11/2005 Park et al. ..... 315/169.1
2006/0038758 A1* 2/2006 Routley et al. ..... 345/81

FOREIGN PATENT DOCUMENTS

JP 2003-162255 6/2003
JP 2004-004876 A 1/2004
JP 2004-233526 A 8/2004
WO WO03103061 A1 * 12/2003

OTHER PUBLICATIONS

Japanese Office Action dated Mar. 7, 2011 issued in corresponding Japanese Patent Application No. 2005-063754.
Japanese Office Action dated May 20, 2011 issued in corresponding Japanese Patent Application No. 2005-063754.

* cited by examiner

*Primary Examiner* — Chanh Nguyen
*Assistant Examiner* — Sanghyuk Park
(74) *Attorney, Agent, or Firm* — Westerman, Hattori, Daniels & Adrian, LLP

(57) ABSTRACT

Drive voltages corresponding to forward voltages for colors R, G, and B are supplied to display pixels for colors R, G, and B arranged on a display panel to correct disruption of a color balance due to aging and temperature dependence of EL elements. The maximum voltage among the drive voltages is detected, and a predetermined voltage is added to the maximum voltage by a charge pump or the like, so that an operation voltage of a level shifter in a gate driver is obtained. An operation signal having a level equal to that of the operation voltage is supplied to a gate of a transistor arranged in each pixel. Therefore, regardless of aging or the like, the control transistor accurately executes an ON operation at a timing for scanning to make it possible to prevent an image display from being defective.

15 Claims, 8 Drawing Sheets

DEVICE FOR DRIVING ACTIVE MATRIX LIGHT-EMITTING DISPLAY PANEL BY CONTROLLING DRIVE VOLTAGE

BACKGROUND OF THE INVENTION

1. Field of the Invention

The present invention relates to a device and a method for driving an active matrix light-emitting display panel which selectively luminescently drive a large number of light-emitting elements which exhibit different emission colors by using, e.g., TFTs (Thin Film Transistors).

2. Description of the Related Art

Along with the popularization of a mobile telephone, a personal digital assistant (PDA), and the like, a demand for a display panel which has a high-definition image display function and can realize a small thickness and a low power consumption increases. As a display panel which satisfies the demand, liquid crystal panels are conventionally applied to a large number of products. On the other hand, in recent years, an organic EL (Electro-Luminescence) element which takes advantage of characteristics of a self-emitting display element is practically used. The display panel draws attention as a next-generation display panel which is replaced with a conventional liquid crystal display panel. This is caused by a background in which an organic compound which can expect preferable light-emitting characteristics is used in a light-emitting function layer of an element to achieve practical high efficiency and practical long life.

The organic EL element, for example, is basically formed such that a transparent electrode consisting of, e.g., ITO, a light-emitting function layer consisting of an organic material, and a metal electrode are sequentially stacked on a transparent substrate such as a glass substrate. The light-emitting function layer may be a single layer consisting of an organic light-emitting layer, a two-layer structure consisting of an organic hole transportation layer and an organic light-emitting layer, a three-layer structure consisting of an organic hole transportation layer, an organic light-emitting layer, and an organic electron transportation layer, or a multi-layer structure obtained by inserting an electron or hole-implanted layer between these appropriate layers.

The organic EL element can be electrically expressed by an equivalent circuit as shown in FIG. 1. More specifically, the organic EL element can be electrically replaced with a configuration constituted by a diode component E serving as a light-emitting element and a parasitic capacitive component Cp coupled in parallel to the diode component E. The organic EL element is considered as a capacitive light-emitting element.

When a light-emitting drive voltage is applied to the organic EL element, first, electric charges corresponding to the electric capacitance of the element flow into the electrode as a displacement current and are accumulated in the electrode. Subsequently, when the voltage exceeds a predetermined voltage (light-emitting threshold voltage=Vth) inherent in the element, a current begins to flow from one electrode (anode side of the diode component E) to the organic layer constituting the light-emitting layer. It can be understood that light emission occurs with an intensity which is in proportion to the current.

FIGS. 2A to 2D show light-emitting static characteristics of such an organic EL element. According to this, the organic EL element, as shown in FIG. 2A, emission occurs with a luminance L which is appropriately proportional to a drive current I. As indicated by a solid line in FIG. 2B, a drive voltage V is equal to or higher than an emission threshold voltage Vth, the current I rapidly flows to emit light.

In other words, when the drive voltage is equal to or lower than the emission threshold voltage Vth, a current rarely flows in the EL element, and the EL element does not emit light. Therefore, the EL element has the following luminance characteristic. That is, as indicated by a solid line in FIG. 2C, in an emittable region in which the drive voltage is larger than the threshold voltage Vth, as the voltage V applied to the EL element increases, an emission luminance L increases.

On the other hand, it is known that the organic EL element has physical properties which change in long-term use to increase a forward voltage Vf. For this reason, In the EL element, as shown in FIG. 2B, a V-I (L) characteristic changes in a direction indicated by an arrow (characteristic indicated by a broken line) depending on actual operating time. Therefore, the luminance characteristic also decreases.

Furthermore, it is known that the luminance characteristic generally changes as indicated by a broken line in FIG. 2C depending on a temperature. More specifically, the EL element has the following characteristics. That is, in an emittable region in which the drive voltage is larger than the emission threshold voltage, as the voltage V applied to the EL element increases, the emission luminance L of the EL element increases. However, the temperature increases, the emission threshold voltage decreases. Therefore, a minimum applied voltage with which the EL element is set in an emittable state decreases as the temperature increases. Even though a predetermined emittable applied voltage is given, the EL element is bright at a high temperature and dark at a low temperature. That is, the luminance is dependent on temperature.

In addition, the EL elements disadvantageously have luminous efficiencies to a drive voltage which change depending on emission colors. As the luminous efficiencies of EL elements which can be practically used and emit R (Red), G (Green), and B (Blue) lights, in an early stage, as generally shown in FIG. 2D, the emission efficiency of G is high, and the emission efficiency of B is the lowest. Each of the EL elements which emit R, G, and B lights has an aging characteristic and a temperature dependence as shown in FIGS. 2B and 2C.

Therefore, when EL elements which emit R, G, and B lights are arranged as sub-pixels to try to perform, e.g., full-color display, a color balance is disrupted due to a change in environment temperature or aging, and display quality cannot be easily held at a predetermined level. In particular, in a device for driving an active matrix display panel having a configuration in which EL elements are driven at a constant voltage by switching operations of TFTs, as indicated by V-I (L) characteristics shown in FIGS. 2A to 2D, an emission luminance largely varies with a variation of the forward voltage Vf of each element to pose a problem of considerable deterioration of display quality.

For this reason, in order to solve the above problem, monitor elements which monitor the forward voltages Vf of the EL elements which emit R, G, and B lights are prepared. A device for driving a light-emitting display panel in which drive voltages applied to the EL elements which emits the color lights are independently controlled based on the forward voltages Vf obtained by the monitor elements is disclosed in Japanese Unexamined Patent Publication No. 2003-162255.

As described above, when the drive voltages applied to sub-pixels which emit R, G, and B lights are independently controlled in accordance with the aging or the like, the drive circuit constituted by TFTs which luminescently drive EL elements constituting the R, G, and B light-emitting elements are inhibited from being normally driven.

FIG. 3 is to explain the problem. FIG. 3 shows a most basic pixel configuration called a conductance control scheme which is preferably employed when EL elements are used as light-emitting elements. More specifically, the gate of a control transistor Tr1 constituted by an n-channel TFT is connected to a gate driver (not shown) through a scan selecting line A1, and the source is connected to a data driver (not shown) through a data line B1. The drain of the control transistor Tr1 is connected to the gate of a light-emitting drive transistor Tr2 constituted by a p-channel TFT, and one terminal of a charge storing capacitor Cs.

The source of the light-emitting drive transistor Tr2 is connected to the other terminal of the charge storing capacitor Cs and connected to a power supply line P1. An anode of an EL element E1 serving as a light-emitting element is connected to the drain of the light-emitting drive transistor, and the cathode of the EL element E1 is connected to a cathode-side power supply line. The sub-pixels having the above configuration constitute color pixels including the R, G, and B elements as combinations. The large number of color pixels in the form of a matrix in the horizontal and vertical directions on the display panel.

In the above pixel configuration, when an ON voltage is supplied to the gate of the control transistor Tr1 by a gate driver through the scan selecting line A1, the control transistor Tr1 causes a current corresponding to a data voltage from the data line B1 supplied to the source to flow from the source to the drain. Therefore, in the period in which the gate of the control transistor Tr1 has an ON voltage, the charge storing capacitor Cs is electrically charged, and the voltage is supplied to the gate of the light-emitting drive transistor Tr2. therefore, the light-emitting drive transistor Tr2 is turned on based on a voltage between the gate and the source, and a drive voltage supplied through the power supply line P1, e.g., VHR is applied to the EL element E1 to luminescently drive the EL element.

On the other hand, when the gate of the control transistor Tr1 has an OFF voltage, the transistor is set in a cut-off state, and the drain of the control transistor Tr1 is set in an open state. The gate voltage of the light-emitting drive transistor Tr2 is held by electric charges accumulated in the charge storing capacitor Cs, a state in which the drive voltage VHR is applied to the EL element E1 is continued until the next scanning. In this manner, the emission of light from the EL element E1 is kept.

In the pixel configuration shown in FIG. 3, drive voltages (VHR, VHG, and VHB) having different values are applied through the power supply line P1 depending on the colors R, G, and B, respectively. As additionally described as an example in FIG. 3, reference symbol VHR denotes a drive voltage supplied to the sub-pixel for R. For example, the drive voltage is set at 7.0 V. Reference symbol VHG denotes a drive voltage supplied to the sub-pixel for G. For example, the drive voltage is set at 5.5 V. Reference symbol VHB denotes a drive voltage supplied to the sub-pixel for B. For example, the drive voltage is set at 6.0 V.

On the other hand, in the above configuration, voltages the levels of which are equal to those of the voltages VHR, VHG, and VHB are supplied to the sub-pixels for R, G, and B as a source supply voltage VHso supplied from the data driver to the source of the control transistor Tr1 through the data line B1. Therefore, when the control transistor Tr1 is turned on the configuration shown in FIG. 3, the device operates to turnoff the light-emitting drive transistor Tr2. In order to control the device to turn on the light-emitting drive transistor Tr2, as additionally described in FIG. 3, the device is designed to apply −2.0 V as a source supply voltage VLso.

In the above conditions, in order to set the control transistor Tr1 in a scan selecting state, the device must be designed such that a gate control voltage VHga (=9.0 V) having a value obtained by adding a threshold voltage of about 2.0 V at which the control transistor Tr1 can be turned on to the voltage VHR (7.0 V) which is the highest voltage in the voltages VHR, VHG, and VHB can be applied. On the other hand, in order to set the control transistor Tr1 in a non-scanning state, the device must be designed such that a gate control voltage VLga (=−4.0 V) lower than the source supply voltage VLso can be applied.

The light-emitting drive operation is continued based on the above voltage settings, forward voltages corresponding to R, G, and B gradually increase by aging. Accordingly, it is assumed that the voltages VHR, VHG, and VHB increase to 7.5 V, 6.0 V, and 8.0 V, respectively as additionally described as an example. In this case, when the gate control voltage VHga (=9.0 V) is set with respect to the maximum value (=8.0 v) of the source supply voltage VHso applied to the source of the control transistor Tr1, it is impossible to sufficiently turn on the control transistor Tr1. Therefore, an image is defectively displayed on the display panel.

In order to avoid the defect on the display panel, as a gate control voltage applied to the control transistor Tr1, a power supply voltage obtained by adding a threshold voltage at which the control transistor Tr1 can be turned on to the maximum accomplishment value of the voltages VHR, VHG, and VHB may be prepared from the beginning. However, continuous generation of the high voltage disadvantageously causes waste of a battery when use of a mobile device is supposed.

SUMMARY OF THE INVENTION

As described above, it is an object of the invention to provide a device and a method for driving an active matrix light-emitting display panel which can be preferably employed on a display device in which the value of a drive voltage applied to light-emitting display pixels is controlled depending on aging and temperature dependence and which can effectively prevent display of an image on a display panel from being defective by the above factors.

A device for driving a light-emitting display panel according to the invention made to solve the above problems is a device for driving an active matrix light-emitting display panel in which light-emitting elements which exhibit different emission colors are arranged in the form of a matrix as display pixels, and at least control transistors and light-emitting drive transistors to selectively luminescently drive the light-emitting elements are arranged for the display pixels, respectively, including voltage detecting means which detects the maximum voltage among drive voltages applied to the display pixels, and voltage control means which controls output levels of control voltages supplied to the control transistors based on the maximum voltage detected by the voltage detecting means.

A method for driving a light-emitting display panel according to the invention made to solve the above problems is a method for driving an active matrix light-emitting display panel in which light-emitting elements which exhibit different emission colors are arranged in the form of a matrix as display pixels, and at least control transistors and light-emitting drive transistors to selectively luminescently drive the light-emitting elements are arranged for the display pixels, respectively, including the voltage detecting step of detecting the maximum voltage among drive voltages applied to the display pixels, and the voltage control step of controlling output levels of control voltages supplied to the control transistors based on the maximum voltage detected in the voltage detecting step.

DESCRIPTION OF THE PREFERRED EMBODIMENTS

Figure 1:
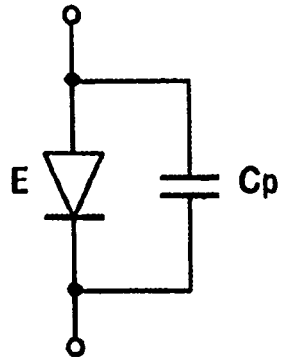
FIG. 1 is an equivalent circuit diagram of an organic EL element.
Figure 2A:
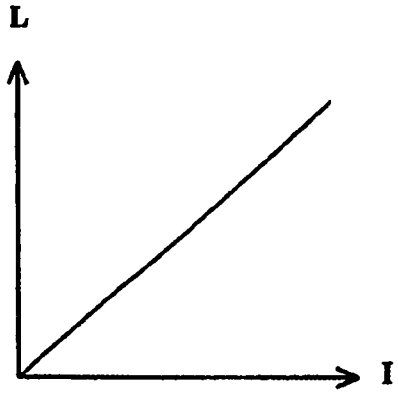
FIGS. 2A to 2D are static graphs showing various characteristics the organic EL element.
Figure 2B:
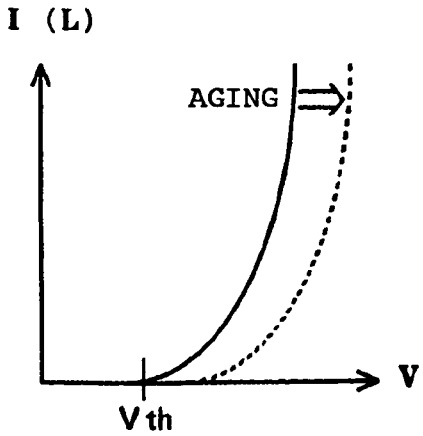
Figure 2C:
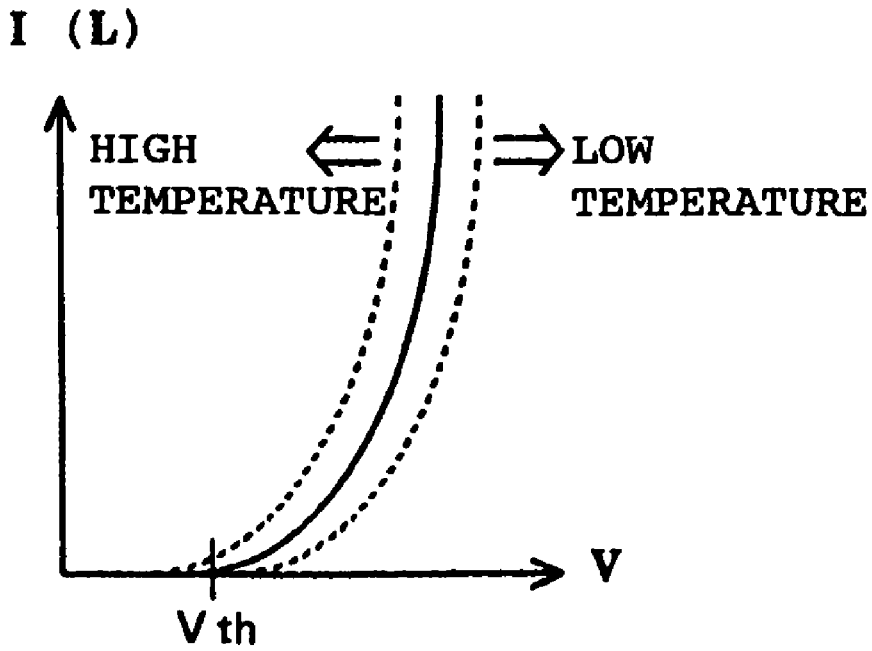
Figure 2D:
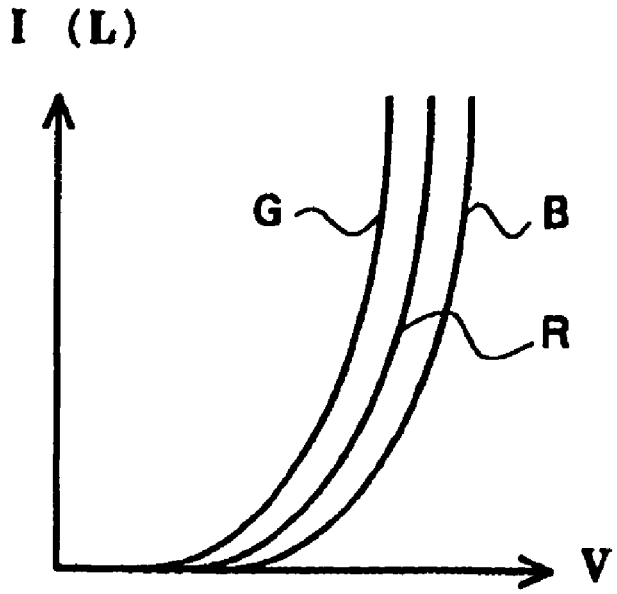
Figure 3:
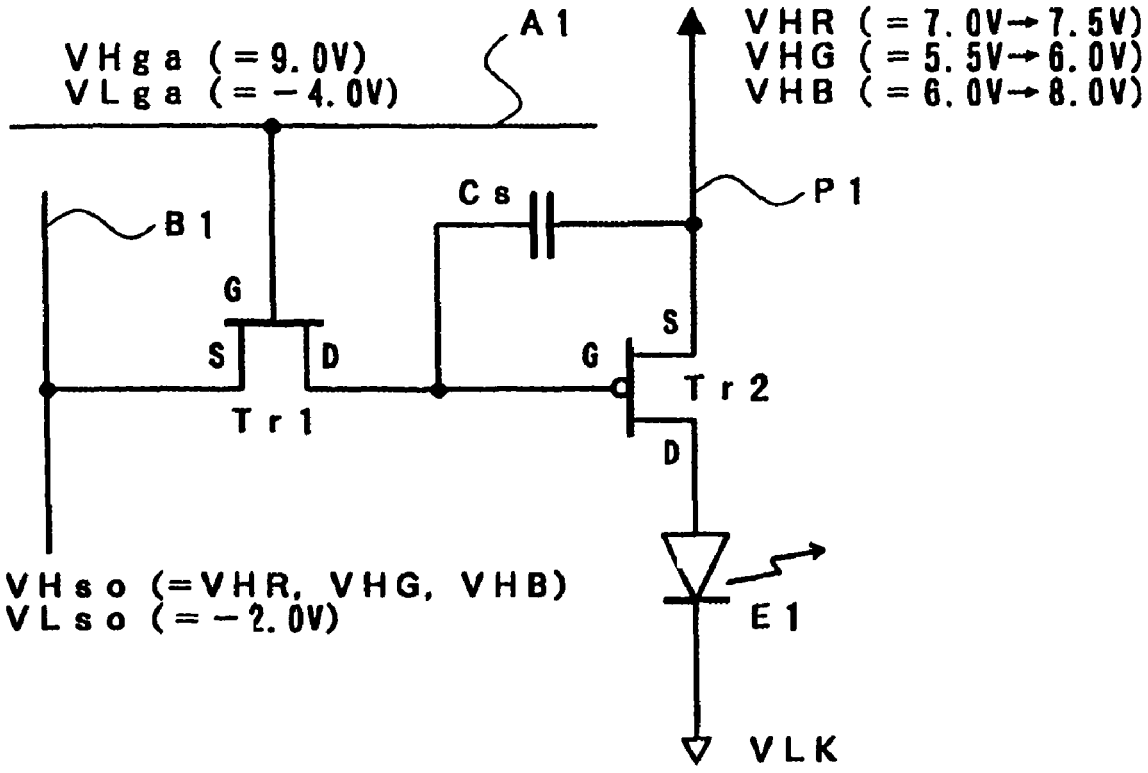
FIG. 3 is a circuit diagram showing a configuration of basic pixels when the organic EL element is used as a light-emitting element.
Figure 4:
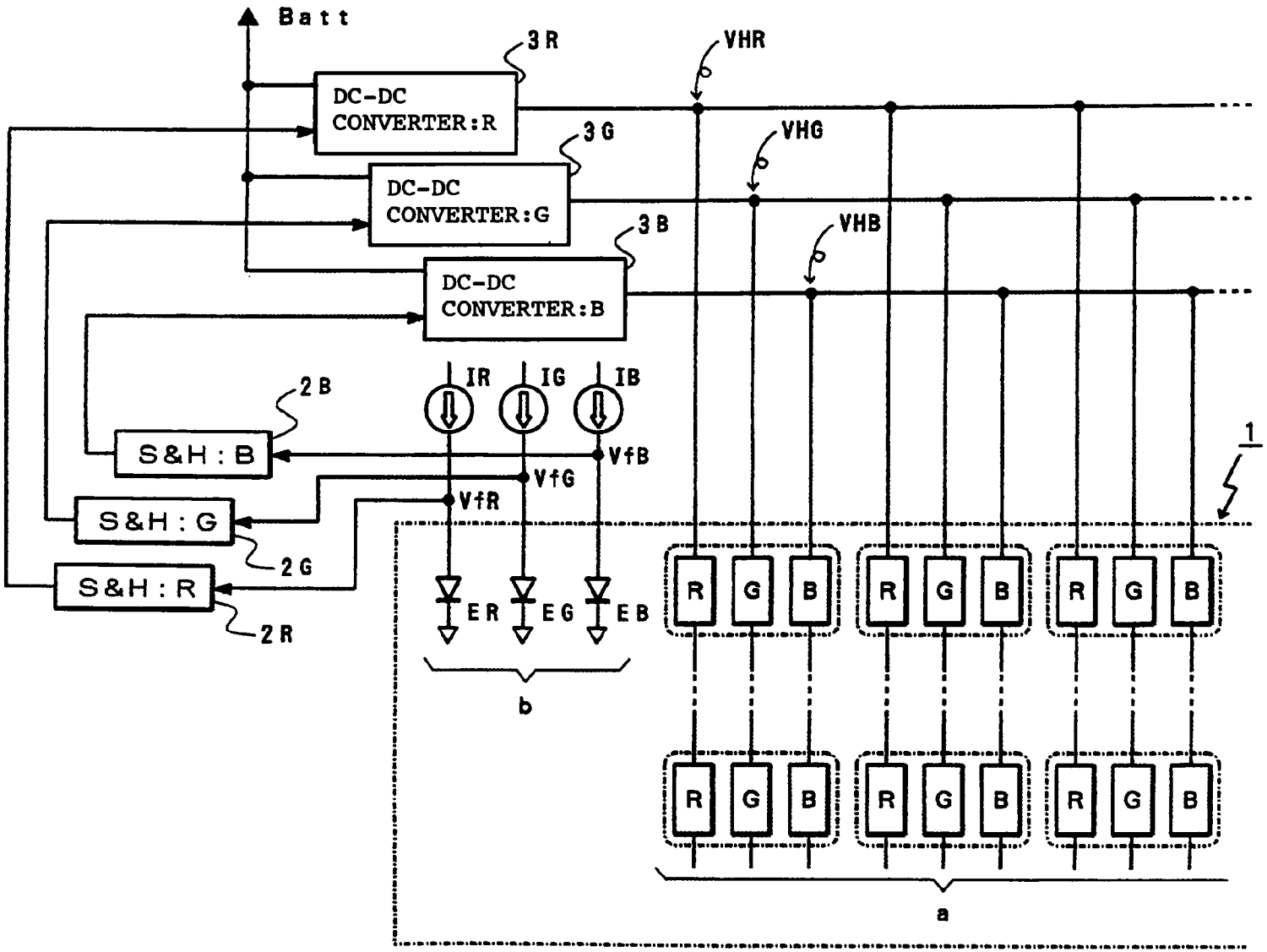
FIG. 4 is a block diagram including drive voltage control means which can preferably employ the invention.

A device for driving a light-emitting display panel according to the present invention will be described below with reference to embodiments shown in the drawings. FIG. 4 shows the basic configuration of the device for driving. Reference numeral 1 denotes an active drive light-emitting display panel. Color display pixels including combinations of sub-pixels indicated by R, G, and B and surrounded by a chain line are arranged in the form of a matrix in a display region a on the display panel 1. In FIG. 4, due to limitations of space, only a partial arrangement of the color display pixels is shown.

An arrangement region b for monitor elements is formed in a part of the display panel 1. In the arrangement region b for the monitor elements, organic EL elements ER, EG, and EB serving as monitor elements corresponding to the colors R, G, and B are arranged at the same time as the film forming step of the display region a. A constant current source IR which supplies a constant current to the monitor element ER corresponding to the color R, a constant current source IG which supplies a constant current to the monitor element EG corresponding to the color G, and a constant current source IB which supplies a constant current to the monitor element EB corresponding to the color B are provided respectively.

In addition, a forward voltage VfR generated when a constant current is supplied from the constant current source IR to the monitor element ER is designed to be supplied to a sample hold circuit 2R, and a forward voltage VfG generated when a constant current is supplied from the constant current source IG to the monitor element EG is designed to be supplied to a sample hold circuit 2G. Furthermore, similarly, a forward voltage VfB generated when a constant current is supplied from the constant current source IB to the monitor element EB is designed to be supplied to a sample hold circuit 2B.

The forward voltages VfR, VfG, and VfB held by the sample hold circuits 2R, 2G, and 2B are designed to be supplied to DC-DC converters 3R, 3G, and 3B serving as switching regulators as control voltages, respectively. Therefore, the DC-DC converters 3R, 3G, and 3B function as drive voltage control means which control the values of drive voltages supplied to the display pixels indicated by reference symbols R, G, and B based on the control voltages serving as the forward voltages VfR, VfG, and VfB held by the sample hold circuits 2R, 2G, and 2B, respectively.

More specifically, a drive voltage VHR is output from the converter 3R based on the forward voltage VfR. The drive voltage VHR is supplied to the display pixel indicated by R as a drive voltage. A drive voltage VHG is output from the converter 3G based on the forward voltage VfG. The drive voltage VHG is supplied to the display pixel indicated by G as a drive voltage. Similarly, a drive voltage VHB is output from the converter 3B based on the forward voltage VfB. The drive voltage VHB is supplied to the display pixel indicated by B as a drive voltage. The DC-DC converters 3R, 3G, and 3B functioning as the drive voltage control means constitute a boosting converter using, e.g., a battery (not shown) as a primary power source.

According to the configuration shown in FIG. 4, a control operation of the output voltages obtained by the DC-DC converters are independently executed for the forward voltages of the colors R, G, and B. Therefore, optimum drive voltage corresponding to an operation temperature and aging can be supplied to the display pixels (sub-pixels) to make it possible to keep a preferable color balance (white balance).

Figure 5:
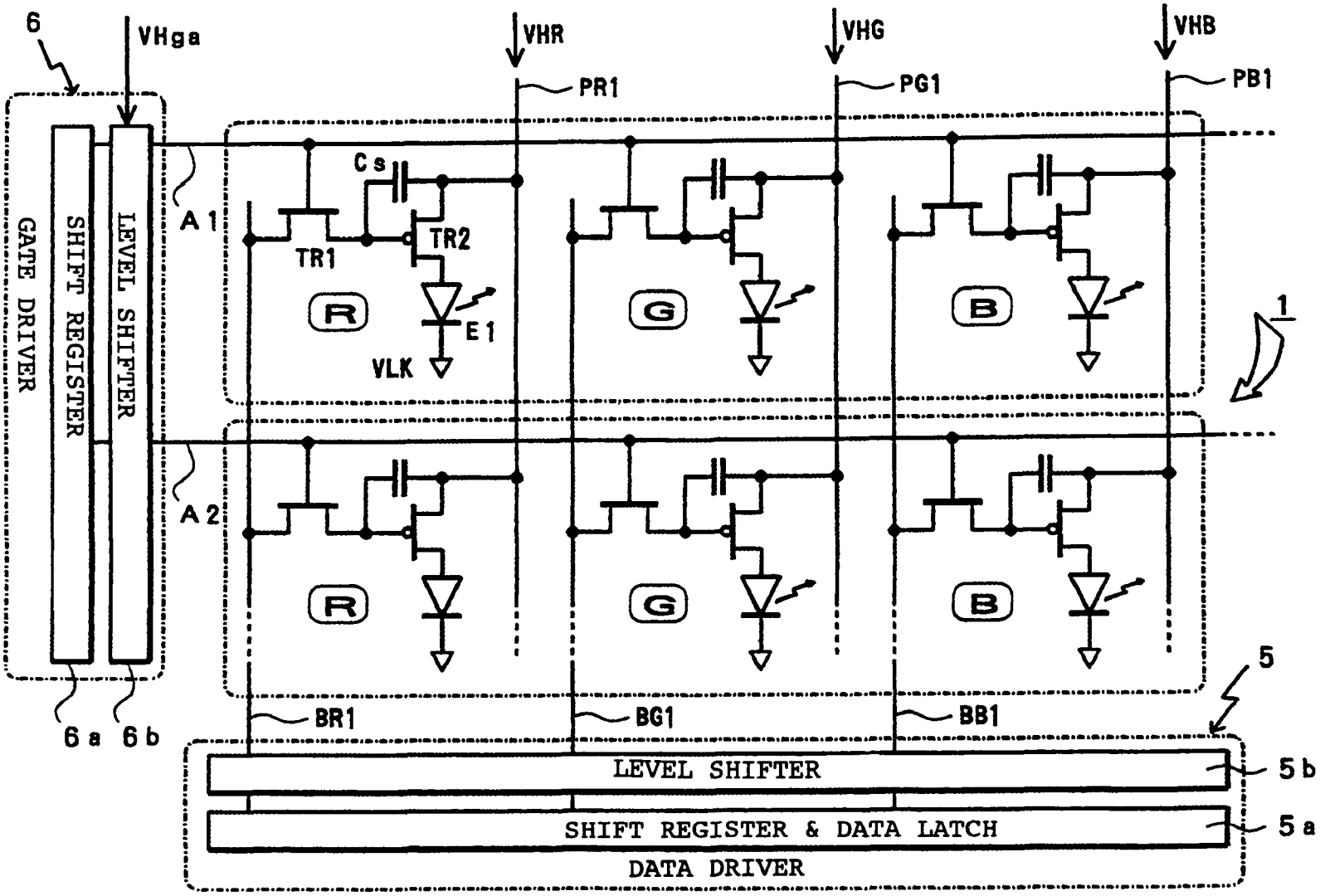
FIG. 5 is a circuit diagram showing a configuration of display pixels shown in FIG. 4 and a configuration of a drive circuit for the display pixels.

FIG. 5 shows the configuration of sub-pixels arranged in the display region a and drivers which luminescently control the sub-pixels. In FIG. 5, due to limitations of space, the configuration of two color pixels each constituted by sub-pixels R, G, and B is shown. The configurations of the sub-pixels are the same as that described with reference to FIG. 4. The same reference symbols as in FIG. 4 denote the same elements constituting sub-pixels at the upper left in FIG. 5, and a detailed description thereof will be omitted.

As shown in FIG. 5, data lines BR1, BG1, BB1, . . . to which data write signals from a data driver 5 are supplied are vertically arranged on the display panel 1. Scan selecting lines A1, A2, . . . to which scan selecting signals (gate control voltages) from a gate driver 6 are supplied are horizontally arranged. The drive voltages VHR, VHG, and VHB brought by the DC-DC converters 3R, 3G, and 3B shown in FIG. 4 are designed to be supplied to the power supply lines.

The data driver 5 in FIG. 5 includes a shift register and a data latch circuit 5*a*. A level shifter 5*b* which shifts the level of a data voltage output from the data latch circuit to a predetermined value is also arranged in the data driver 5. Serial image data and shift clocks for each scan line are supplied from a light-emitting control circuit (not shown) to the shift register to sequentially scan the image data by the shift clocks.

A latch command signal is supplied to the data latch circuit to move image data signals corresponding to one scan line from the shift register to the data latch circuit. The data latch circuit operates to latch the image data signals as parallel data. The levels of the image data latched in this manner are shifted to the levels of the drive voltages VHR, VHG, and VHB, respectively, in the level shifter 5*b*. The resultant image data are supplied to the source electrode of the control transistors Tr1 for the respective pixels as data write signals.

On the other hand, the gate driver 6 in FIG. 5 includes a shift register 6*a* and a level shifter 6*b*. A scan shift clock corresponding to a horizontal synchronous signal is supplied from a light-emitting control circuit (not shown) to the shift register 6*a*. In this manner, the shift register 6*a* arranged for each scan selecting line operates to sequentially generate register outputs. The levels of the register outputs are shifted to be gate control voltages having a predetermined level (will be described later) in the level shifter 6*b*. The resultant register outputs are sequentially output to the scan selecting lines A1, A2, . . . .

Therefore, every scanning operation in the data write period, the display pixels connected to each scan selecting line receive the gate control voltages supplied from the gate driver 6. In synchronism with this, data write signals are supplied in parallel from the level shifter 5*b* in the data driver 5 to the display pixels arranged for each scan selecting line. Electric charges corresponding to the data write signals are written in the electric charge holding capacitors Cs in the pixels corresponding to the scan selecting line. This operation is executed over the all scan selecting lines, so that an image corresponding to one frame is displayed on the display panel 1.

In this case, the configuration shown in FIG. 5 operates such that an output corresponding to the gate control voltage VHga is supplied to the level shifter 6*b* in the gate driver 6 by voltage control means (will be described later). More specifically, in response to the register output from the shift register 6*a*, the level shifter 6*b* in the gate driver 6 operates to output a voltage at the level of the gate control voltage VHga to the scan selecting line as a gate control voltage.

Figure 6:
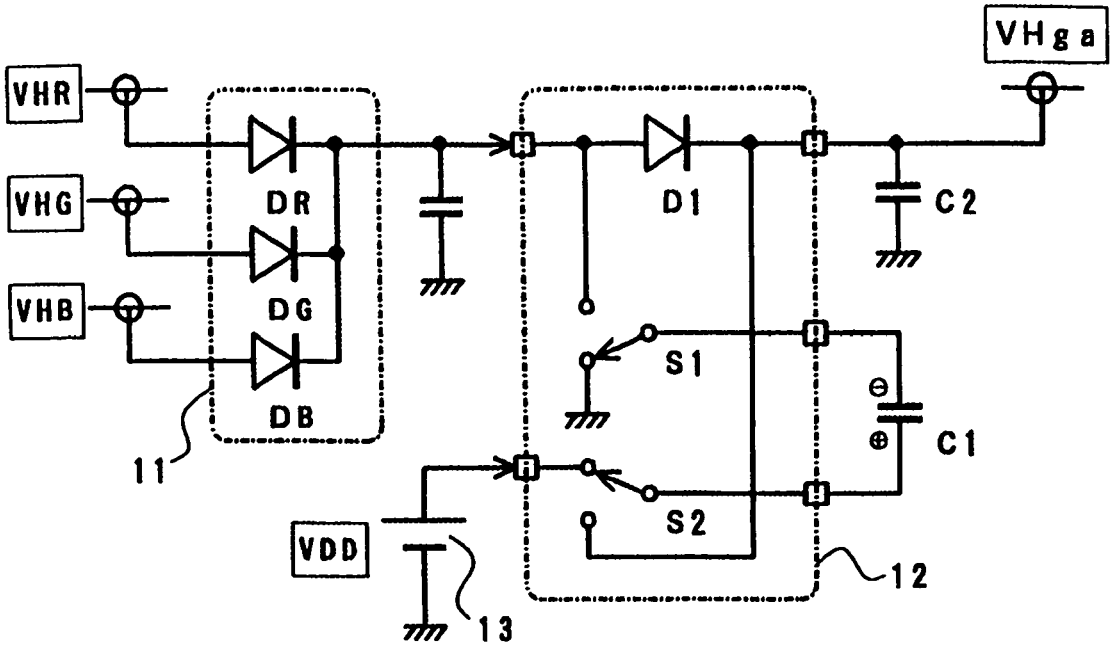
FIG. 6 is a circuit diagram showing first voltage control means in a device for driving according to the invention.

FIGS. 6 to 9 show preferable embodiments of voltage control means which generate the gate control voltage VHga. FIG. 6 shows the first configuration of the voltage control means. In the configuration shown in FIG. 6, voltage detecting means 11 which detects the maximum voltage among drive voltages (VHR, VHG, and VHB) applied to display pixels (sub-pixels) corresponding to the colors R, G, and B already described is arranged.

In the configuration shown in FIG. 6, the voltage detecting means 11 is constituted by three diodes DR, DG, and DB. More specifically, the drive voltages, VHR, VHG, and VHB applied to the display pixels are designed to be supplied to the anode terminals of the diodes DR, DG, and DB, respectively, and cathode terminals of the respective diodes are commonly connected each other. Therefore, the maximum voltage among the drive voltages VHR VHG, and VHB is brought to the respective cathode terminals of the diodes which are commonly connected to each other. Outputs from the diodes are supplied to a charge pump 12 functioning as voltage control means.

A voltage adding capacitor C1 is connected to the charge pump 12. The voltage adding capacitor C1 is designed to be intermittently electrically charged through switches S1 and S2 by a voltage source 13 having a predetermined voltage VDD. A state shown in FIG. 6, the voltage adding capacitor C1 is electrically charged with the predetermined voltage VDD. When the switches S1 and S2 are switched in the opposite direction of the direction in FIG. 6 when the voltage adding capacitor C1 is electrically charged with the predetermined voltage VDD, the voltage adding capacitor C1 is connected to a diode D1 in parallel to each other.

The predetermined voltage VDD is added to the maximum voltage among the drive voltages VHR, VHG, and VHB output from the voltage detecting means 11. The resultant voltage is output to the terminal of a capacitor C2 as VHga. As described with reference to FIG. 5, the output VHga is supplied to the level shifter 6*b* in the gate driver 6. A gate control voltage having a level equal to that of the output VHga is designed to be supplied from the level shifter 6*b* to the gate of the control transistor Tr1 of each pixel.

The predetermined voltage VDD supplied from the voltage source 13 is set at a voltage which is equal to or larger than an inter-gate-source threshold value at which the control transistor Tr1 in each pixel can be turned on, i.e., about 2 V. In this manner, even though the drive voltages VHR, VHG, and VHB supplied to the pixels corresponding to the colors R, G, and B change, in addition to the maximum voltage among the drive voltages VHR, VHG, and VHB, a gate control voltage having a level equal to that of the output VHga to which the voltage VDD is always added is supplied to the gate of the control transistor Tr1. Therefore, regardless of aging and an operation temperature, the control transistor Tr1 accurately executes an ON operation to make it possible to prevent image display from being defective.

Figure 7:
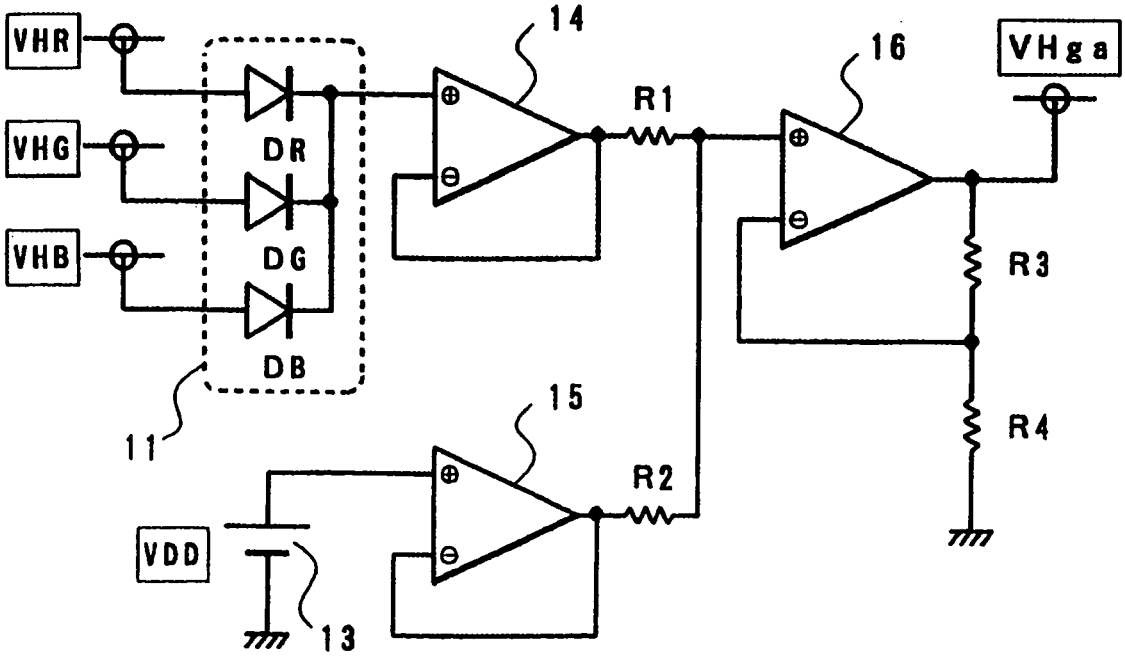
FIG. 7 is a circuit diagram showing second voltage control means in the device for driving.

FIG. 7 shows the second configuration of the voltage control means. Also in the configuration shown in FIG. 7, as in the example shown in FIG. 6, voltage detecting means 11 constituted by three diodes DR, DG, and DB is arranged. An output from the voltage detecting means 11 is supplied to an operational amplifier 14 functioning as a buffer amplifier. An output from a voltage source 13 having a predetermined voltage VDD equal to that in the example described with reference to FIG. 6 is also supplied to an operational amplifier 15 functioning as a buffer amplifier.

Resistors R1 and R2 having equal resistances are connected to the output terminals of the operational amplifiers 14 and 15, respectively. Therefore, an intermediate voltage between the maximum voltage from the voltage detecting means 11 and the predetermined voltage VDD is generated at a common connection point between the resistors R1 and R2. The intermediate voltage is amplified by a DC amplifier constituted by an operational amplifier 16 including feedback resistors R3 and R4. The feedback resistors R3 and R4 are set at equal resistances to make the gain of the DC amplifier constituted by the operational amplifier 16 twice. Therefore, an output obtained by substantially adding the predetermined voltage VDD to the maximum voltage among the drive voltages VHR, VHG, and VHB is brought to the output terminal of the operational amplifier 16 as VHga.

Therefore, the output VHga brought by the operational amplifier 16 is used in the level shifter 6*b* in the gate driver 6 as described above to make it possible to obtain the same operation effect as described above.

Figure 8:
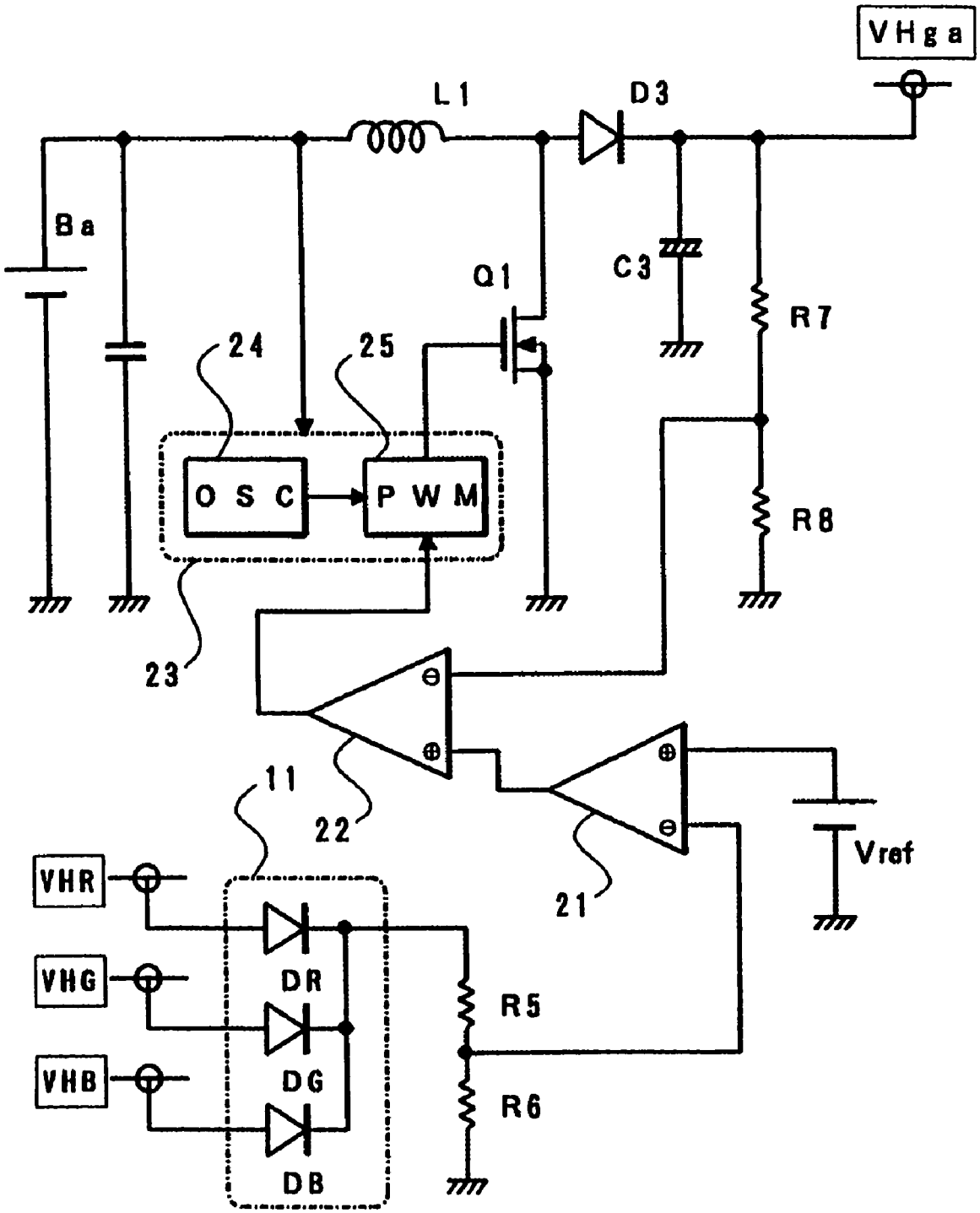
FIG. 8 is a circuit diagram showing third voltage control means in the device for driving.

FIG. 8 shows the third configuration of the voltage control means. In the configuration shown in FIG. 8, a DC-DC converter is used. As an output control voltage of the DC-DC converter, an output from the voltage detecting means 11 constituted by three diodes DR, DG, and DB as in the example shown in FIG. 6 is used.

The output from the voltage detecting means 11 is designed to be divided by resistors R5 and R6 and supplied to one input terminal (inverted input terminal) in an error amplifier 21. A reference voltage Vref is supplied to the other input terminal (non-inverted input terminal) in the error amplifier 21. Therefore, in the error amplifier 21, a comparative output (error output) between an output from the voltage detecting means 11 and the reference voltage Vref is generated.

An output by the error amplifier 21 is designed to be supplied to one input terminal (non-inverted input terminal) in an error amplifier 22 constituted by an operational amplifier. Furthermore, voltage-divided outputs by resistors R7 and R8 which divides the output voltage VHga in the DC-DC converter is designed to be supplied to the other input terminal (inverted input terminal) in the error amplifier 22. Therefore, an output voltage in the error amplifier 22 includes output information of both the output from the voltage detecting means 11 and the output VHga in the DC-DC converter.

In the configuration shown in FIG. 8, the boosting DC-DC converter is used, and an output from the error amplifier 22 is designed to be output to a switching signal generating circuit 23. The switching signal generating circuit 23 includes a reference triangular-wave oscillator 24 and a PWM circuit 25. The PWM circuit 25 includes a comparator (not shown). An output from the error amplifier 22 and a triangular wave from the reference triangular-wave oscillator 24 are supplied to the comparator to generate a PWM signal from the PWM circuit 25.

A pulse signal obtained by PWM from the PWM circuit 25 is supplied to the gate of a power FET Q1 to perform a switching operation to the FET Q1. More specifically, the ON operation of the FET Q1 accumulates power energy from a battery Ba in an inductor L1. On the other hand, with an OFF operation of the FET Q1, the power energy accumulated in the inductor is accumulated in a capacitor C3 through a diode D3.

The ON/OFF operations of the FET Q1 are repeated to make it possible to obtain a boosted DC output as a terminal voltage of a capacitor C3. The terminal output serves as the output voltage VHga from the converter. The output voltage VHga, as described above, is divided by the resistors R7 and R8 to be fed back to the error amplifier 22. The divided voltages operate to maintain the predetermined output voltage VHga.

Even in the configuration constituted by the DC-DC converter, a predetermined voltage, i.e., the predetermined voltage VDD described with reference to FIGS. 6 and 7 is substantially added to the maximum voltage among the drive voltages VHR, VHG, and VHB obtained by the voltage detecting means 11. In this state, the voltage can be output as the output voltage VHga.

Therefore, the output VHga brought by the DC-DC converter having the above configuration is used in the level shifter 6*b* in the gate driver 6 as described above to make it possible to obtain the same operation effect as described above.

Figure 9:
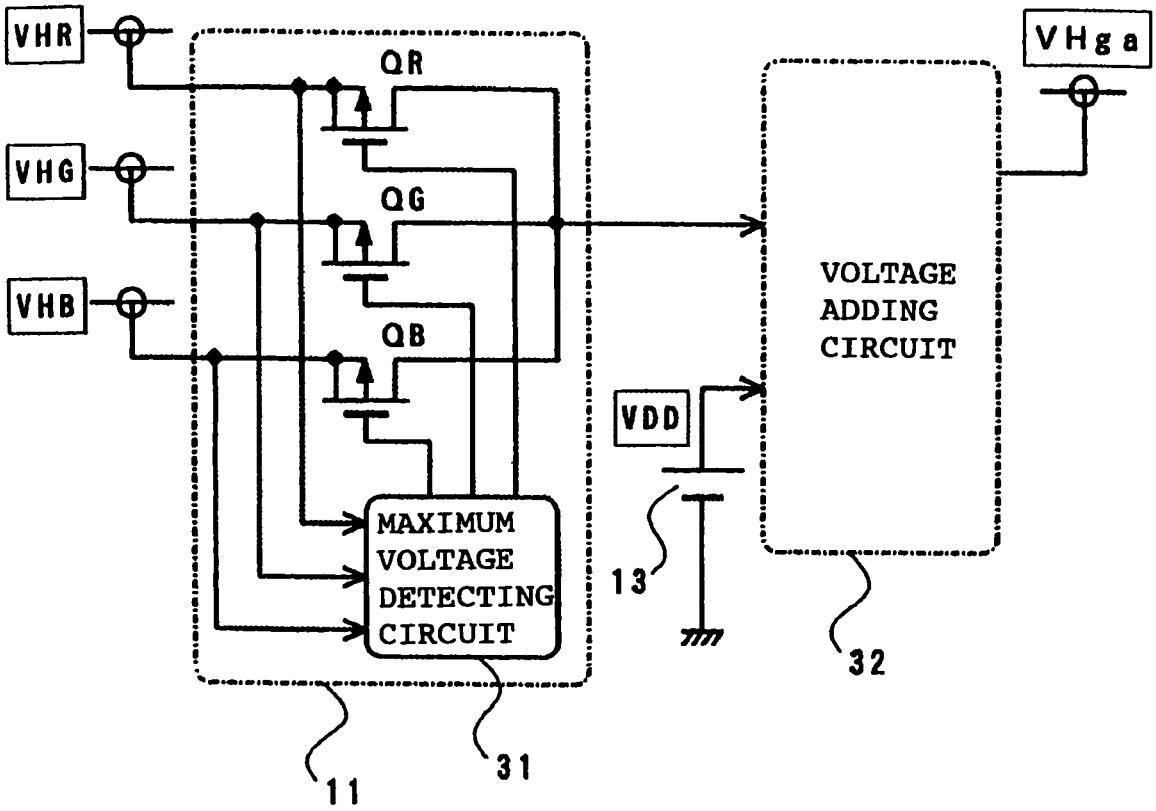
FIG. 9 is a circuit diagram showing another example of voltage detecting means used in voltage control means.

FIG. 9 shows another configuration of the voltage detecting means 11. In this example, analog switches QR, QG, and QB functioning switching elements are used in place of the diodes. More specifically, the analog switches QR, QG, and QB are constituted by FETs, and the drive voltages VHR, VHG, and VHB applied to the display pixels are designed to be supplied to the sources of the analog switches QR, QG, and QB, respectively. The drains of the FETs are commonly connected to each other.

The drive voltages VHR, VHG, and VHB are designed to be supplied to a maximum potential detecting circuit 31. Any one of the FETs corresponding to the maximum voltage detected by the circuit 31 is designed to be turned on. Therefore, the maximum voltage among the drive voltages VHR, VHG, and VHB is brought to the source terminals of the FETs commonly connected to each other.

An output obtained by the voltage detecting means 11 shown in FIG. 9 is supplied to a voltage adding circuit 32. In this case, as in the example explained with reference to FIGS. 6, 7, an output from the voltage source 13 having the predetermined voltage VDD is added to the output to obtain an output VHga. As the voltage adding circuit 32, the circuit constituted by the charge pump shown in FIG. 6 or the combination of the three operational amplifiers shown in FIG. 7 can be employed.

In the embodiment described above, the organic EL elements are used as the light-emitting elements arranged on the display panel. However, even though other light-emitting elements having aging and temperature dependence as shown in FIGS. 2A to 2D are used, the same operation effect as described above can be achieved.

What is claimed is:

1. A device for driving an active matrix light-emitting display panel in which light-emitting elements which exhibit different emission colors are arranged in a form of a matrix as display pixels, and at least control transistors and light-emitting drive transistors to selectively luminescently drive the light-emitting elements are arranged for the display pixels, respectively, gates of the control transistors being connected to a gate driver through scan selecting lines, sources of the control transistors being connected to a data driver through data lines, sources of the light-emitting drive transistors being connected to power supply lines, drains of the light-emitting drive transistors being connected to anodes of the light-emitting elements, drive voltages being supplied to the power supply lines from DC-DC converters comprising:

a voltage detector which detects a maximum voltage among the drive voltages applied to the light-emitting elements in the display pixels through the power supply lines, wherein values of the drive voltages are designed to be controller with respect to forward voltages of the light-emitting elements which exhibit different emission colors, respectively; and a voltage controller which controls output levels of control voltages supplied to the gates of the control transistors based on the maximum voltage detected by the voltage detecting means, wherein the voltage controller is constituted by a charge pump which adds a predetermined voltage to the maximum voltage detected by the voltage detector;

wherein said detected voltage is indicative of a voltage at a drain or source of the drive transistors.

2. The device for driving an active matrix light-emitting display panel according to claim 1, wherein the voltage control means has a configuration which generates an intermediate voltage by the maximum voltage detected by the voltage detecting means and the predetermined voltage and amplifies the intermediate voltage in DC.

3. The device for driving an active matrix light-emitting display panel according to claim 1, wherein the voltage control means is constituted by a DC-DC converter which controls the output levels of control voltages by adding a predetermined voltage to the maximum voltage among the drive voltages obtained by the voltage detecting means.

4. The device for driving an active matrix light-emitting display panel according to claim 1, wherein the voltage detector includes diodes having one terminal to which the drive voltages are supplied and the other terminals commonly connected to each other such that the maximum voltage is obtained at a common connection point of the diodes.

5. The device for driving an active matrix light-emitting display panel according to claim 1, wherein the voltage detecting means includes switching elements having one terminal to which the drive voltages are supplied and the other terminals commonly connected to each other such that the switching element corresponding to the maximum value of the drive voltages is turned on.

6. The device for driving an active matrix light-emitting display panel according to claim 1, wherein the value of the control voltage supplied to the gate of the control transistor is set to be not less than a threshold value at which an inter-gate-source voltage of the control transistor can be turned on.

7. The device for driving an active matrix light-emitting display panel according to claim 1, wherein the display pixels include light-emitting elements which emit red, green and blue light, respectively.

8. The device for driving an active matrix light-emitting display panel according to claim 1, wherein light emitting elements are organic EL elements including at least one light-emitting function layer consisting of an organic material.

9. The device for driving an active matrix light-emitting display panel according to claim 1, wherein the detected voltage is the drain voltage or source voltage of said drive transistors.

10. A method for driving an active matrix light-emitting display panel in which light-emitting elements which exhibit different emission colors are arranged in a form of a matrix as display pixels, and at least control transistors and light-emitting drive transistors to selectively luminescently drive the light-emitting elements are arranged for the display pixels, respectively gates of the control transistors being connected to a gate driver through scan selecting lines, sources of the control transistors being connected to a data driver through data lines, sources of the light-emitting drive transistors being connected to power supply lines, drains of the light-emitting drive transistors being connected to anodes of the light-emitting elements, drive voltages being supplied to the power supply lines from DC-DC converters comprising:

voltage detecting step of detecting a maximum voltage among the drive voltages applied to the light-emitting elements in the display pixels through the power supply lines, wherein values of the drive voltages are designed to be controlled with respect to forward voltages of the light-emitting elements which exhibit different emission colors, respectively; and a voltage control step of controlling output levels of control voltages supplied to the gates of the control transistors based on the maximum voltage detected in the voltage detecting step, and wherein said detected voltage is indicative of a voltage at a drain or source of the drive transistors; and in the voltage control step, an operation of adding a predetermined voltage to the maximum voltage obtained in the voltage detecting step by a charge pump is executed to control the output levels of the control voltages.

11. The method for driving an active matrix light-emitting display panel according to claim 10, wherein in the voltage control step, an intermediate voltage is generated by the maximum voltage obtained in the voltage detecting step and the predetermined voltage, and the intermediate voltage is amplified in DC to execute an operation of controlling the output levels of the control voltages.

12. The method for driving an active matrix light-emitting display panel according to claim 10, wherein in the voltage control step, the output levels of the control voltages are controlled by the DC-DC converter which adds a predetermined voltage to the maximum voltage obtained in the voltage detecting step.

13. The method for driving an active matrix light-emitting display panel according to claim 10, wherein in the voltage detecting step, the drive voltages are supplied to one terminal of a diode, respectively to obtain the maximum voltage at the other terminals of diodes commonly connected to each other.

14. The method for driving an active matrix light-emitting display panel according to claim 10, wherein in the voltage detecting step, the drive voltages are supplied to one terminal of switching elements, respectively, and the switching element corresponding to the maximum voltage among the drive voltages is turned on to obtain the maximum voltage at the other terminals of the switching elements commonly connected to each other.

15. The method for driving an active matrix light-emitting display panel according to claim 10, wherein the detected voltage is the drain voltage or source voltage of said drive transistors.

* * * * *